US009205675B2

(12) United States Patent
Samweber

(10) Patent No.: US 9,205,675 B2
(45) Date of Patent: Dec. 8, 2015

(54) DEVICE FOR DRYING A RECORDING MEDIUM WHICH IS PRINTED WITH INK IN A PRINTER, AND METHOD THEREFOR

(75) Inventor: Joachim Samweber, Eichenau (DE)

(73) Assignee: Océ Printing Systems GmbH, Poing (DE)

( * ) Notice: Subject to any disclaimer, the term of this patent is extended or adjusted under 35 U.S.C. 154(b) by 317 days.

(21) Appl. No.: 13/883,375

(22) PCT Filed: Nov. 8, 2011

(86) PCT No.: PCT/EP2011/069605

§ 371 (c)(1),
(2), (4) Date: May 30, 2013

(87) PCT Pub. No.: WO2012/062731

PCT Pub. Date: May 18, 2012

(65) Prior Publication Data

US 2013/0235138 A1 Sep. 12, 2013

(30) Foreign Application Priority Data

Nov. 11, 2010 (DE) ..... 10 2010 060 489

(51) Int. Cl.
*B41J 11/00* (2006.01)
*B41J 15/04* (2006.01)

(52) U.S. Cl.
CPC ..... *B41J 11/0015* (2013.01); *B41J 11/002* (2013.01); *B41J 15/04* (2013.01)

(58) Field of Classification Search
CPC ..... B41J 11/0085
See application file for complete search history.

(56) References Cited

U.S. PATENT DOCUMENTS

| | | | | |
|---|---|---|---|---|
| 5,274,399 | A * | 12/1993 | Uchida et al. | 346/134 |
| 5,529,410 | A * | 6/1996 | Hunter et al. | 400/234 |
| 5,568,241 | A | 10/1996 | Creutzmann | |
| 5,729,817 | A * | 3/1998 | Raymond et al. | 399/384 |
| 5,793,397 | A * | 8/1998 | Barker et al. | 347/88 |
| 6,454,478 | B2 | 9/2002 | Wotton et al. | |
| 6,554,415 | B2 | 4/2003 | Juan | |
| 6,857,803 | B2 | 2/2005 | Smith | |
| 6,869,484 | B2 * | 3/2005 | Hunt et al. | 118/718 |
| 7,384,036 | B2 | 6/2008 | Kruijt | |

(Continued)

FOREIGN PATENT DOCUMENTS

| | | |
|---|---|---|
| DE | 2717119 | 10/1978 |
| DE | 3642204 | 6/1987 |
| EP | 0997302 | 2/2005 |

*Primary Examiner* — Stephen Meier
*Assistant Examiner* — John P Zimmerman
(74) *Attorney, Agent, or Firm* — Schiff Hardin LLP

(57) ABSTRACT

In a method or device to dry a web-shaped recording medium in a printer, the web-shaped recording medium is printed with aqueous ink and subsequently directed with a predetermined web tension past a heatable body whose contact surface that faces towards the recording medium is brought into contact with a side of said recording medium that has not been freshly printed to dry said recording medium in a drying operation. A first guide element is arranged before the heatable body and a second guide element is arranged after the heatable body, the first and second guide elements guiding the recording medium. The contact surface of the heatable body is substantially flat. A negative pressure device generates a negative pressure at the contact surface facing towards the recording medium. The negative pressure is deactivated in a halt operation, the deactivation process taking place continuously over an adjustable time interval.

11 Claims, 4 Drawing Sheets

(56) References Cited

U.S. PATENT DOCUMENTS 7,681,978 B2 * 3/2010 Hirato ..... 347/19
2010/0073450 A1 3/2010 Katagami et al.
2010/0245451 A1 9/2010 Ihara
2010/0253721 A1 * 10/2010 Matsumoto et al. ..... 347/9

* cited by examiner

DEVICE FOR DRYING A RECORDING MEDIUM WHICH IS PRINTED WITH INK IN A PRINTER, AND METHOD THEREFOR

BACKGROUND

The disclosure concerns a device to dry a web-shaped recording medium in a printer in which said recording medium is printed with ink. The disclosure also concerns an associated operating method.

High-capacity printers that operate according to the inkjet principle print to a web-shaped recording medium via application of aqueous ink without the print heads being moved for printing. The web-shaped recording medium can thus be moved with relatively high transport speed (for example 1.5 m/s), such that the necessity exists to dry the damp print image via suitable devices. One possibility exists in the heating of the recording medium.

A thermal fixing device to fix toner images on a belt-shaped recording medium in an electrophotographic printing apparatus is known from U.S. Pat. No. 5,568,241 (WO 94/09410). The device includes a thermoprinting fixing station, upstream of which is situated a preheating station. This preheating station includes a convexly curved preheating saddle that is heated by means of heating rods and over whose sliding surface the recording medium is transported. The saddle-shaped sliding surface is formed in a curved shape. Due to the curvature and the necessary web tension, a force component results over the length of the preheating saddle, which force component presses the recording medium onto the sliding surface and thus establishes a good thermal contact. A negative pressure device is additionally provided that generates a negative pressure between the sliding surface and the recording medium, via which the recording medium is drawn onto the sliding surface of the heating saddle and the water vapor that is released by the preheating is drawn off.

Due to the curvature and the friction, the web tension of the recording medium increases over the length of the heating saddle. The contact pressure force therefore also changes over this length, and the thermal transfer between the recording medium and the surface of the heating saddle is not constant, which can lead to a non-uniform heating of the recording medium. Furthermore, it is also difficult to individually adjust the necessary thermal transfer for different paper types, ink types and print speeds. A compensation with the aid of heat controllers is technically complicated and difficult. Add to this slip-stick effects that arise due to non-uniform mechanical friction between the sliding surface of the preheating saddle and the recording medium. These disruptive slip-stick effects in particular occur upon turning on and off the transport of the recording medium.

DE-A-27 17 119 describes a drying device for a recording medium that is printed with the aid of an inkjet print head. After leaving the print zone, the recording medium is directed over a heated paper guide plate and dried. A heating film serves for heating.

DE-A-36 42 204 describes a drying device for a recording medium that has been printed with a printer operated according to the inkjet principle. Before the ejection of the ink by the print head, the recording medium is heated so that sufficient heat is still stored in the recording medium even after the ink inks said recording medium.

US 2010/0073450 A1 describes a device to dry a web-shaped recording medium in an inkjet printer in which the ink head is moved back and forth over a paper surface to be printed. For this, the web-shaped recording medium is borne on a cuboid, heatable body and is charged with negative pressure so that a segment of the heatable paper web is held stationary for printing, and the heat transferred from the heatable body to the paper dries the ink. After printing, the paper web is then transported further in order to print a next segment.

US 2010/0245451 A1 describes an inkjet printer in which multiple rows of print heads are arranged transverse to the transport direction of a sheet-shaped paper. Situated opposite the print heads is a heatable body on which the sheet of paper rests. The paper is drawn on with the aid of negative pressure, whereby the ink is dried on the one hand and the print heads are cooled by the drawn air on the other hand.

SUMMARY

It is an object to specify a device and a method in which a uniform drying of the recording medium is achieved.

In a method or device to dry a web-shaped recording medium in a printer, the web-shaped recording medium is printed with aqueous ink and subsequently directed with a predetermined web tension past a heatable body whose contact surface that faces towards the recording medium is brought into contact with a side of said recording medium that has not been freshly printed to dry said recording medium in a drying operation. A first guide element is arranged before the heatable body and a second guide element is arranged after the heatable body, the first and second guide elements guiding the recording medium. The contact surface of the heatable body is substantially flat. A negative pressure device generates a negative pressure at the contact surface facing towards the recording medium. The negative pressure is deactivated in a halt operation, the deactivation process taking place continuously over an adjustable time interval.

DESCRIPTION OF PREFERRED EXEMPLARY EMBODIMENTS

Figure 1:
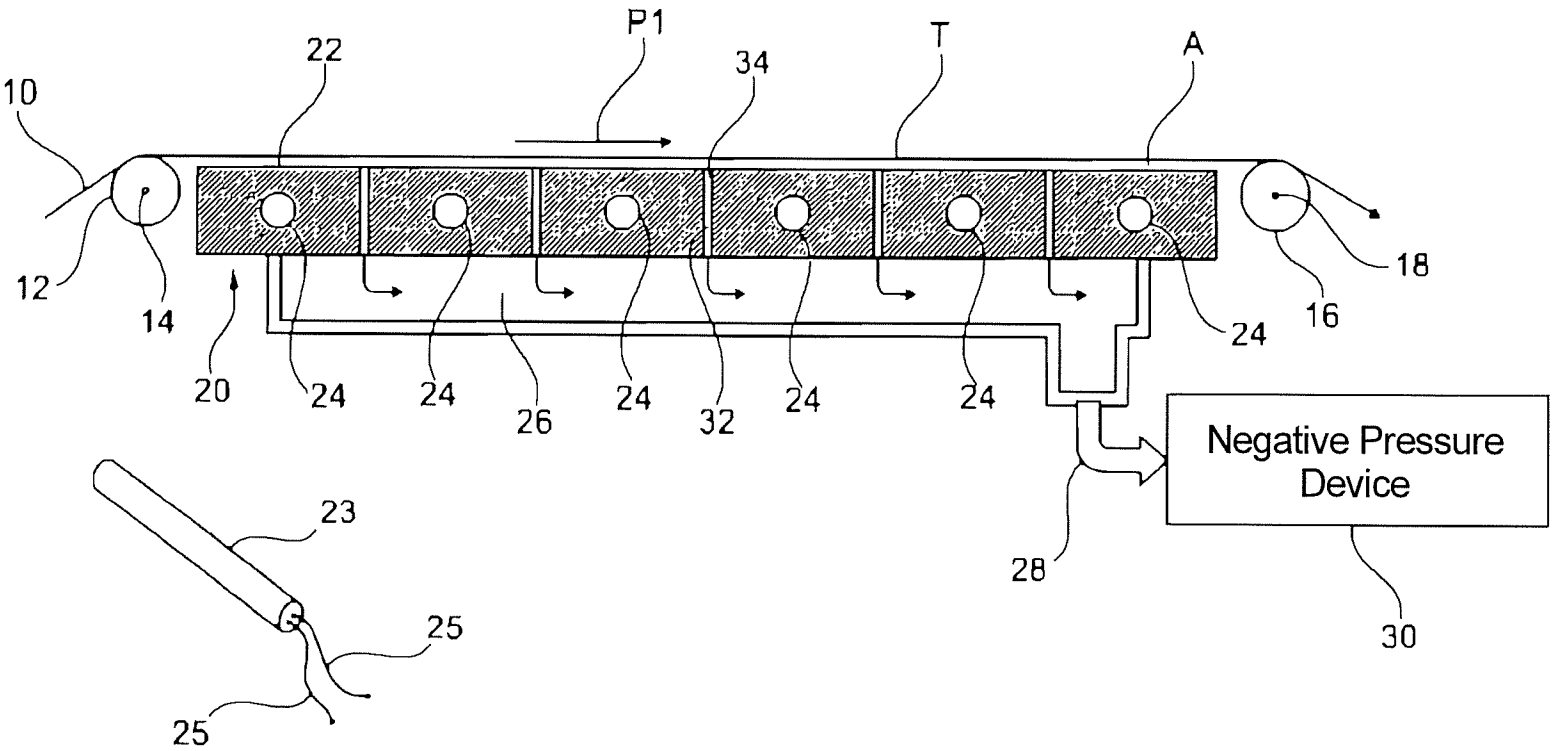
FIG. 1 illustrates a device to dry a web-shaped recording medium with a flat contact surface.

For the purpose of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

According to an exemplary embodiment a contact surface of a heatable body is essentially flat and, in a drying process, runs essentially congruently with a tangential plane that is defined by a first and a second guide element. Due to the absence of curvature of the contact surface, the friction with the recording medium (which is advantageously printed with aqueous ink) is markedly reduced and is no longer dependent on the web tension. This means that, given different recording media (for example different papers), the web tension can be varied without the heat transfer being affected. Disruptive slip-stick effects also cease. The contact pressure force for a good thermal contact between the contact surface of the heatable body and the recording medium is essentially established by the negative pressure of the negative pressure device. If the contact surface runs vertically (such that the weight of the recording medium plays no role), the contact pressure is solely dependent on the negative pressure, which is easily adjustable. The friction between the recording medium and the contact surface at any point is dependent only the negative pressure prevailing there, which can be adjusted so that it acts constantly over the entire contact surface. A linear connection thus arises between negative pressure and friction, such that self-reinforcing effects and no disrupting influences occur in the thermal contact.

According to one development, in normal printing operation the negative pressure device generates a negative pressure of 14 to 30 mbar (advantageously 14 to 22 mbar) relative to the environment. Given these values a sufficient contact pressure force for a good heat transfer is generated on the one hand, and on the other hand the acting friction force is not too large in relation to the web tension and the water vapor can be reliably drawn off.

The force with which the recording medium is pressed onto the contact surface is variable via adjustment of the negative pressure. In this way the device can be adapted to different types of recording media (for example different paper).

According to a further exemplary embodiment, in a halt operation the negative pressure of the negative pressure device can be deactivated. In this case, the heat transfer between recording medium and contact surface is largely suppressed and the recording medium is not stressed. This is primarily advantageous for a pause function in which the printing operation is briefly interrupted. Given use of a curved heating saddle, for example, it is not possible to largely suppress the heat transfer, such that the recording medium dries out in places.

According to a further exemplary embodiment, it is provided that the deactivation process for the negative pressure takes place continuously over an adjustable time interval. In this way the contact pressure force is continuously reduced and disruptive forces acting on the recording medium are reduced. The adjustable time interval is advantageously equal to the time interval within which the transport speed of the recording medium is braked from the speed upon printing to zero. In the pause operation of the printer or upon halting as a result of an error, the transport speed of the recording medium is not abruptly stopped since this would increase the web tension too greatly and stress the recording medium too greatly. In this exemplary embodiment, the contact pressure force—and therefore the heat transfer between recording medium and heatable body—reduces to the extent to which the transport speed is reduced.

According to a further aspect of the exemplary embodiment, a method is specified for drying a recording medium printed with ink in a printer. The advantageous effects described further above in connection with the device are achieved with the aid of this method.

Exemplary embodiments of the invention are explained in the following using drawing figures.

In a schematic cross section, FIG. 1 shows an exemplary embodiment of the device to dry a web-shaped recording medium 10 (generally a paper web) that is transported in the transport direction P1 in a high-capacity printer that operates according to the inkjet principle. This high-capacity printer (not shown) includes a plurality of inkjet print heads that print simultaneously, such that a high print speed is achieved and the transport speed of the recording medium 10 can amount to up to 2 m/s or more. The recording medium 10 is directed over a first guide roller 12 (which rotates around a first axle 14) and a second guide roller 16 (which rotates around a second axle 18) with a predetermined web tension that is generated by corresponding assemblies within the high-capacity printer. The tangential plane T that belongs to the guide rollers 12, 16 coincides with the plane in which the recording medium 10 is transported.

A heatable body 20 is arranged below the recording medium 10. This recording medium 10 has previously been freshly printed by inkjet print heads with aqueous ink on the side facing away from the body 20. The body 20 has its upward contact surface 22 facing towards the side of the recording medium 10 that is not freshly printed. The contact surface 22 is essentially flat and, during drying operation, runs essentially congruently with the tangential plane T that is spanned by the first guide roller 12 and the second guide roller 16. In the shown operation (not the drying operation), a distance A exists between the tangential plane T and the flat contact surface 22, as is explained further below. If A is equal to zero, the drying operation is present.

The heating of the body 20 takes place via electrical resistance elements in the form of cylindrical heating elements 23 that are arranged in bores 24 in the body 20, which heating elements 23 are arranged so as to be exchangeable. A heating element 23 with electrical feed lines 25 is shown from the side in FIG. 1. Defective heating elements can easily be removed from the bores 24 in this way and be exchanged for others. The body 20 can be produced from a single metal body, for example via milling. However, the body 20 can also be composed of various parts by means of connecting elements. The body advantageously comprises aluminum. The design of the heating elements and their electrical control can be as this is described in the aforementioned U.S. Pat. No. 5,568,241.

Below the body 20, this is connected with a negative pressure chamber 26 that is connected via a negative pressure line 28 with a negative pressure device 30. This negative pressure device 30 generates a negative pressure relative to the environment so that said negative pressure acts between the contact surface 22 and the recording medium 10. Typical values for the normal printing operation and the normal drying operation are 14 to 30 mbar, advantageously 14 to 22 mbar. At these values, a good contact between the recording medium 10 and the contact surface 22 is provided so that the heat of the body 20 transfers to the recording medium 10 and dries this. With the aid of the heating elements 23, the body 20 can be adjusted to temperatures of 70 to 80° C. for relatively thin recording media and from 120 to 150° C. for relatively thick recording medium. The negative pressure can likewise be adapted to the type of recording medium 10 in order to thus be able to vary the heat transfer for drying. An adaptation to the transport speed of the recording medium 10 can also take place in this way. The body 20 can be subdivided by means of different heating elements into different heat zones that have different temperatures. The mentioned U.S. Pat. No. 5,568, 241, which describes such heat zones, is referenced in this regard. This document is incorporated as well by reference into the disclosure content of the present application.

The negative pressure prevailing in the negative pressure chamber 26 is directed via channels 32 (only one channel 32 is provided with a reference character) to slits 34 (only one slit is provided with the reference character 34) to the surface of the body 20 in order to deploy its suction effect at the recording medium 10. The slits 34 are designed so that only air at the edge of the recording medium 10 is laterally drawn up. In this suction process, water vapor that arises in the drying of the aqueous ink is also drawn off, such that it does not affect the heat transfer between the recording medium 10 and the contact surface 22. Up to 24 liters of water in the form of water vapor can typically accumulate per hour in normal printing operation.

Figure 2:
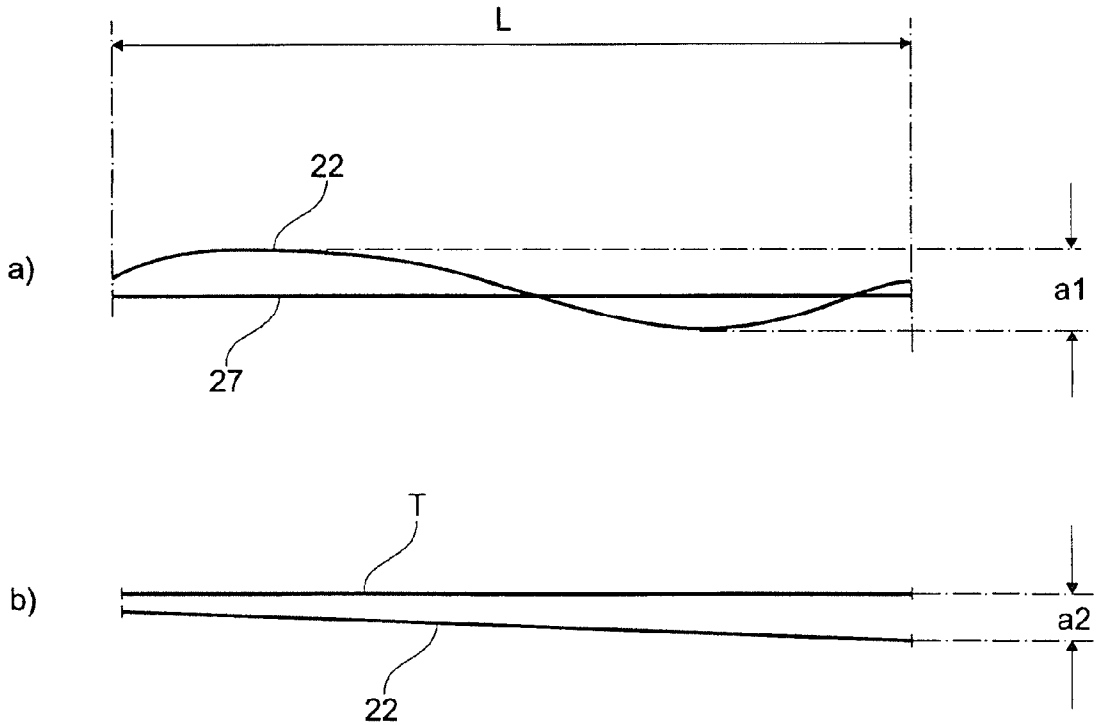
FIG. 2 illustrates an overview of permissible shape deviations for the flat contact surface.

In two representations a) and b), FIG. 2 shows an ideal shape 27 of the contact surface over its length L. In the practice of engineering surfaces, an ideal flatness is not to be achieved; rather, dimensional deviations result, in particular dimensional deviations of the first order that are also designated as a shape deviation. In the representation a) it is apparent that the actual deviation of the real contact surface 22 from the ideal contact surface 27 should be less than a1=3 mm over the length L. Long convex and/or concave shape deviations can accordingly arise over the length L. The technical effect of the good heat transfer and the reduction of the friction force that are to be achieved are still provided given these cited shape deviations. The shape deviation of the contact surface 22 from the ideal tangential plane T—which coincides with the transport plane of the recording medium 10 in the section between the two guide rollers 12, 16—is shown in representation b). A maximum deviation of up to 3 mm from a2 is still provided over the entire length L of the heatable body 20. The length L is typically in a range from 500 to 800 mm for a high-capacity printer.

Figure 3:
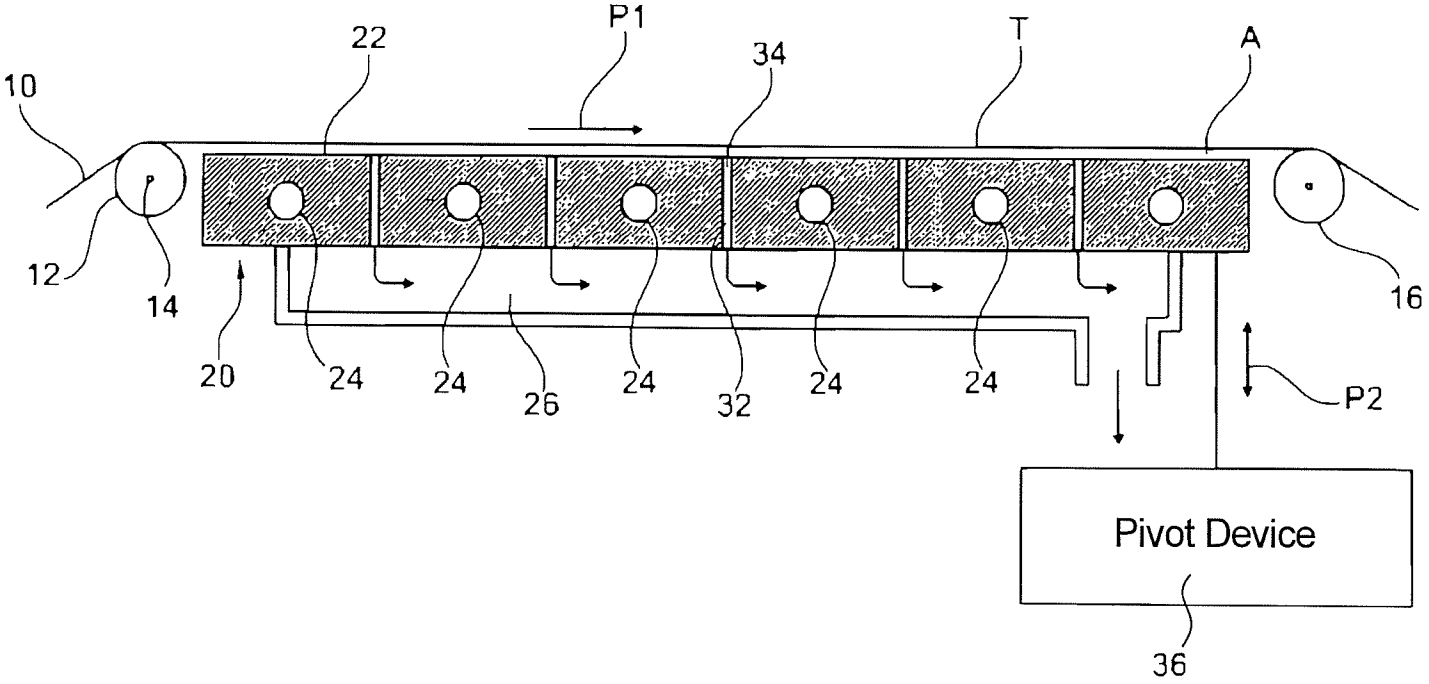
FIG. 3 illustrates a further exemplary embodiment with a pivoting device.

FIG. 3 shows a variant of the example according to FIG. 1. A pivot device strikes the body 20 and moves the body 20 in the direction of the double arrow P2. In this way the distance A between the contact surface 22 and the recording medium 10 can be adjusted in the halt operation in which a drying should not take place, or should take place only to a limited extent. In printing operation, the body 20 is then moved by the pivot device 36 so that the distance A is zero and the contact surface 22 coincides with the tangential surface T. If the body 20 is pivoted away from the recording medium 10, the influence of heat on the recording medium 10 is nearly completely suppressed. In this state, a printing pause can last a relatively long time. Due to the flat contact surface 22, the web length between the guide rollers 12, 16 is unchanged by the pivoting of the body 20 away, which markedly improves the print quality in start/stop operation.

Figure 4:
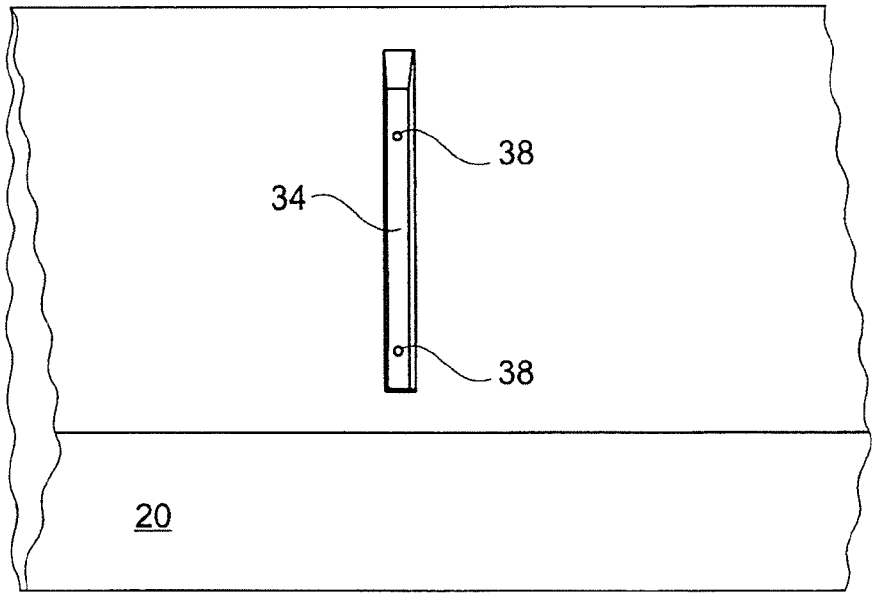
FIG. 4 illustrates a perspective representation of a section of the heatable body from above.

FIG. 4 shows in perspective a section of the heatable body 20 from above. The slit 34 runs over the width of the body 20 and is formed as a depression in the body 20. The slit 34 opens into channel 38, which is connected with the negative pressure chamber 26 and via which air and vapor are drawn off.

As is apparent using the exemplary embodiments, the use of a flat, heatable body is advantageous because the friction between recording medium and contact surface is no longer dependent (as in a curved contact surface) on the web tension, which for reasons of the exact web travel can be markedly higher than is necessary for the heat transfer. Given different recording media—for example different papers—the web tension in the printer can be varied accordingly without affecting the heat transfer. In practice, markedly reduced friction values result via the use of the flat contact surface. In practice, measurements resulted in a reduction of the friction forces by one third of the friction that otherwise occurs at a curved guide surface. By deactivating the negative pressure, the heat transfer between the recording medium and the heatable body can advantageously be largely suppressed so that the recording medium no longer dries out. This is advantageous for the pause operation.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A device to dry a previously printed moving web-shaped recording medium in an ink-jet printer, comprising:

a heatable body past which is directed said previously printed web-shaped recording medium that has previously been freshly printed with ink before being transported to the heatable body and which has a predetermined web tension, said heatable body having a contact surface that faces towards the moving recording medium and which is brought into contact with a side of said recording medium that has not been freshly printed to dry said moving recording medium in a drying operation while the recording medium is moving;

a first guide element arranged before said heatable body as viewed in a transport direction of the recording medium and which receives said previously printed moving recording medium, and a second guide element arranged after the heatable body, said first and second guide elements respectively guiding the moving recording medium;

said contact surface being substantially flat and, for drying, runs substantially congruently with a tangential plane defined by the first guide element and the second guide element;

a negative pressure device being provided via which a negative pressure relative to an environment is generated at the contact surface facing towards the moving recording medium when the recording medium is moving; and the negative pressure being deactivated in a halt operation of the recording medium so that when the recording medium is halted and not moving the negative pressure is deactivated, the deactivation taking place continuously by continuously reducing the negative pressure over an adjustable time interval.

2. The device according to claim 1 in which a force with which the recording medium is pressed onto the contact surface is variable via adjustment of the negative pressure of the negative pressure device.

3. The device according to claim 1 in which the substantially flat contact surface has a dimension deviation deviating by less than 3 mm from an ideal plane over its length.

4. The device according to claim 1 in which the negative pressure device generates a negative pressure of 14 to 30 mbar relative to the environment in normal printing operation.

5. The device according to claim 1 wherein the time interval for the deactivation process is equal to a time interval within which a transport speed of the recording medium is braked from a speed during printing to a zero speed.

6. The device according to claim 1 in which a deviation between said tangential plane and a plane that is defined by the contact surface is smaller than 3 mm during the drying operation.

7. The device according to claim 1 in which the first and second guide elements are designed as guide rollers.

8. The device according to claim 1 in which a pivoting device is provided that adjusts a distance between the tangential plane and the contact surface in the halt operation.

9. A method to print and dry a moving web-shaped recording medium in an inkjet printer, comprising the steps of:

printing the moving web-shaped recording medium with aqueous ink and subsequently directing the moving medium with a predetermined web tension past a heatable body after the printing and whose contact surface that faces towards the recording medium is brought into contact with a side of said recording medium that has not been freshly printed to dry said recording medium in a drying operation after the printing and while the medium is moving;

arranging a first guide element before the heatable body as viewed in a transport direction of the recording medium receiving said previously printed moving web and arranging a second guide element after the heatable body, said first and second guide elements respectively guiding the recording medium, said heatable body contact surface being substantially flat and, during the drying operation, runs substantially congruently with a tangential plane defined by the first guide element e and the second guide element;

generating with a negative pressure device a negative pressure relative to an environment at the contact surface facing towards the recording medium when the medium is moving; and deactivating the negative pressure in a halt operation, the deactivation process taking place continuously over an adjustable time interval.

10. An inkjet printer to print and to dry a moving web-shaped recording medium, comprising:

a plurality of ink-jet printheads which eject ink for printing on the recording medium;

a heatable body located after the printheads and past which is directed said moving web-shaped recording medium that has previously been freshly printed with ink and which has a predetermined web tension, said heatable body having a contact surface that faces towards the recording medium and which is brought into contact with a side of said recording medium that has not been freshly printed to dry said recording medium in a drying operation;

a first guide element arranged after the printheads and before said heatable body as viewed in a transport direction of the recording medium, and a second guide element arranged after the heatable body, said first and second guide elements respectively guiding the recording medium;

said contact surface being substantially flat;

a negative pressure device being provided via which a negative pressure relative to an environment is generated at the contact surface facing towards the recording medium when the recording medium is moving; and the negative pressure being deactivated in a halt operation of the recording medium.

11. A method to print and dry a moving web-shaped recording medium in an ink-jet printer, comprising the steps of:

printing the moving web-shaped recording medium with aqueous ink and subsequently directing the moving medium past a heatable body after the printing and whose contact surface that faces towards the recording medium is brought into contact with a side of said recording medium that has not been freshly printed to dry said recording medium in a drying operation after the printing and while the medium is moving;

arranging a first guide element before the heatable body as viewed in a transport direction of the recording medium receiving said previously printed moving web and arranging a second guide element after the heatable body, said first and second guide elements respectively guiding the recording medium, said heatable body contact surface being substantially flat, and which during the drying operation, runs substantially congruently with a tangential plane defined by the first guide element and the second guide element;

generating with a negative pressure device a negative pressure relative to an environment at the contact surface facing towards the recording medium when the medium is moving; and deactivating the negative pressure in a halt operation when the medium speed is reduced to zero.

* * * * *